United States Patent [19]

Gallagher, Jr.

[11] Patent Number: 4,595,315

[45] Date of Patent: Jun. 17, 1986

[54] ANCHOR BOLT ASSEMBLY

[75] Inventor: Hugh M. Gallagher, Jr., Cincinnati, Ohio

[73] Assignee: Consolidated Metal Products, Inc., Cincinnati, Ohio

[21] Appl. No.: 615,219

[22] Filed: May 30, 1984

[51] Int. Cl.[4] ..... E02D 20/02

[52] U.S. Cl. ..... 405/261; 405/260; 411/2

[58] Field of Search ..... 405/261, 260, 262; 411/2, 3; 52/698, 704

[56] References Cited

U.S. PATENT DOCUMENTS

| | | | |
|---|---|---|---|
| 3,702,060 | 11/1972 | Cumming | 405/261 |
| 3,877,235 | 4/1975 | Hill | 405/261 |
| 3,940,941 | 3/1976 | Libert et al. | 405/261 |
| 3,979,918 | 9/1976 | Vidler | 405/261 |
| 4,023,373 | 5/1977 | Hipkins | 405/261 |
| 4,122,681 | 10/1978 | Vass et al. | 405/261 |
| 4,132,080 | 1/1979 | Hansen | 405/261 |
| 4,295,761 | 10/1981 | Hansen | 405/261 |
| 4,303,354 | 12/1981 | McDowell, Jr. | 405/261 |
| 4,477,209 | 10/1984 | Hipkins et al. | 405/261 |

FOREIGN PATENT DOCUMENTS

| | | | |
|---|---|---|---|
| 1143597 | 3/1983 | Canada | 411/2 |
| 0637560 | 12/1978 | U.S.S.R. | 411/3 |

*Primary Examiner*—Dennis L. Taylor

*Attorney, Agent, or Firm*—Wood, Herron & Evans

[57] ABSTRACT

An anchor bolt assembly for mounting within a bore formed in a rock structure, to strengthen the rock structure, comprises a shaft having a leading section and a bottom threaded section. A nut which may be attached to a face plate washer is threaded onto the end of the bottom section and bonded by an adhesive material thereto. A cartridge or capsule of anchoring cement is inserted into the bore and pierced by the leading section of the shaft as it is advanced into the bore. The shaft and nut are rotated as a unit to mix and distribute the anchoring cement within the bore and along the length of the leading section. Once the anchoring cement sets to secure the shaft in position within the bore, additional torque is applied to rotate the nut and break its adhesive bond with the bottom section. The nut is then advanced along the bottom section until the face plate washer is tightened against the rock structure.

13 Claims, 7 Drawing Figures

ANCHOR BOLT ASSEMBLY

BACKGROUND OF THE INVENTION

This invention relates to supports for strengthening rock structures, and, more particularly, to an improved chemical or resin type anchoring bolt assembly.

The roofs and walls of coal mines, subway tunnels, and other subterranean structures often require anchor bolts to strengthen the rock mass. Two basic anchor bolt designs are currently in use; mechanically operated anchor bolts and chemical or resin anchor bolts. Mechanical anchor bolts typically include a threaded shaft having a leading end which is disposed within a split sleeve or cylinder and inserted into a bore formed in the rock structure. When the shaft is rotated, the sleeve is urged apart and engages the sides of the bore in the rock structure to maintain the shaft in place. The outwardly extending end of the shaft includes a washer or bearing plate which contacts the outside surface of the rock structure as the shaft is rotated to provide the necessary tension pullup or tightening down of the shaft. Standards promulgated by the Bureau of Mines require installed bolt tension to be on the order of 50% of the yield strength of the bolt.

The primary disadvantage of mechanical-type anchor bolts is that they require relatively strong and stable rock stratum to provide the tension on the order of 50% of yield strength of one bolt. In many applications, looser type of formations are encountered such as mudstone or siltstone, limestone, sandstone, or shale. Weaker rock formations of this type are not adequately supported by mechanical anchor bolts.

As a result of the development in recent years of fast setting resin compounds and the inadequacy of mechanical anchor bolts in weaker stratum, chemical type anchor bolts have been developed in which the bolt is secured within a bore drilled into a rock formation by a resin material. Most chemical type anchor bolts employ a cartridge or capsule of polyester resincatalyst material which is first inserted into the bore in the rock formation. The leading end of the anchor bolt is advanced into the bore to pierce the resin-catalyst cartridge and then it is rotated to mix and disperse the material or anchoring cement within the bore and along the bolt. After a predetermined period of mixing, the bolt is held in place to allow the resin to set. The trailing end of the chemical anchor bolt extends outwardly from the bore when the bolt is properly positioned, and, in some designs, is threaded to receive a nut having a faceplate washer. After the cement has completely set to fix the anchor bolt in place, the nut is then independently rotated and advanced along the trailing end of the bolt until the faceplate engages the rock mass and provides tension pullup or tightening down of the bolt.

Proper installation of this type of chemical-type anchoring bolt thus involves a two stage rotational movement of the bolt and nut. Initially, the bolt and nut are rotated together as a unit so that the resin and catalyst in the rock bore are properly mixed and distributed therealong. Once the cement has set and fixed the bolt in place, additional torque is applied to the nut to advance it along at least a portion of the trailing end of the bolt.

Several prior art designs have been proposed for a chemical anchor bolt structure which permits a two stage rotational movement such as described above. Most of these designs are directed to providing means for releasably securing the nut or movable element of the anchor bolt to the trailing end of the bolt shaft, or fixed element, so as to permit unitary movement of the shaft and nut as the resin-catalyst are being mixed, and thereafter allowing the nut to release from the bolt without breaking the bond between the resin and leading end of the bolt. In U.S. Pat. No. 3,877,235 to Hill, for example, the leading end of a cylindrical anchor having a welded end piece at its trailing end is inserted within a bore formed in a rock structure. The threaded shank of a bolt is threaded through a nut mounted to the trailing end of the cylindrical anchor and the head of the bolt extends outwardly from the rock bore and attaches to a bearing plate or washer. The bolt and anchor move as a unit while the resin-catalyst within the bore is mixed to form the anchoring cement. After the cement sets to secure the anchor in place within the bore, the bolt is rotated independently of the anchor so that its inward end pierces the welded end piece of the anchor permitting the washer at the head of the bolt to be tightened against the rock face. In this design, the welded end piece of the anchor permits rotation of the bolt independently of the anchor as the anchoring cement is mixed, but is adapted to break away and allow the bolt to advance within the anchor after the cement has set.

Another common design of chemical anchoring bolts is disclosed, for example, in U.S. Pat. Nos. 4,023,373; 4,122,681 and 4,132,080 which describe a modification of the Hill anchor bolt. As in Hill, a threaded bolt is provided which extends into the bore of the rock structure through a nut mounted at the trailing end of an anchor disposed within the bore. The head of the bolt extends outwardly from the bore and attaches to a bearing plate. Unlike Hill, the anchor of such patented designs does not include a welded end piece; instead, the bolt threads or the threads of the nut attached to the anchor are deformed in some manner to prevent advancement of the bolt through the nut unless a predetermined torque is applied. In operation, both the bolt and anchor rotate as a unit while the adhesive is mixed and distributed along the bore, but after the adhesive is permitted to set, additional torque is applied to the bolt to overcome the interference caused by the thread deformation so that the washer may be advanced into contact with the rock structure.

Further examples of chemical anchor bolts are found in U.S. Pat. Nos. 3,702,060; 3,940,941; and 3,979,918. These patents disclose a shaft threaded at each end, and its leading end is inserted within a bore formed in the rock structure. The threaded, trailing end of the shaft extends outwardly of the bore and is adapted to receive a nut. In each patent, an exposed nut at the end of the bolt shank functions for mixing the resin and, after the resin sets, enables the bolt structure to be tightened to place tension on the bolt. The structures disclosed in these patents all have in common a shaft and nut which are rotated in unison to mix a resin-catalyst material placed in the rock bore, and after the resin has set to fix the shaft in place, sufficient directional torque is applied to the nut to overcome the resistance created by a mechanical deformation or stop for the nut so that a faceplate or washer may be advanced by the nut to contact the surface of the rock structure. Another example of a chemical anchor bolt is shown in U.S. Pat. No. 4,303,354.

There are may disadvantages associated with known chemical-type anchoring bolts where the temporary or the threaded anchor bolt and nut permit unitary movement of the two elements to mix the resin and then separate motion of the nut after the resin is set in place within the rock bore to tighten the bolt. All of the means for interfering with the motion of the bolt relative to an anchor, or the nut along the threaded shaft, mentioned above, are mechanical or structural. In practice a mechanical distortion or stop in the thread of the bolt which cooperates with a nut does not provide an effective fail-safe anchor bolt for the miner who works in very cramped conditions and relies upon his sense of touch. Frequently, distortion of threads gives the miner a false torque of when the nut is tightened which makes the miner believe the bolt is tensioned when, in fact, it is not. On the other hand, if the nut turns freely in the bolt shaft due to a defective thread, the miner may believe the resin is being mixed with the curing agent when, in fact, it is not. In other words, currently available bolt and nut devices which have a mechanical or structural connection between the bolt and nut are not fail-safe devices. Such devices are also subject to variations in tolerances or environmental conditions which could affect the torque required to break the movable element free of the fixed element for movement therealong. If a greater torque than desired is required to break the movable element free, the integrity of the bond between the leading end of the anchor or shaft and the cement may be weakened rendering the anchor bolt useless. On the other hand, if too little torque is required to break the structural connection between the bolt and anchor, or nut and shaft, the bolt or nut may become detached while the resin is being mixed and prematurely advance within the anchor, or along the shaft, before the cement has had time to set.

SUMMARY OF THE INVENTION

In a broad aspect of this invention, an anchor bolt assembly is provided having a fixed anchoring element and a movable, tightening element which are joined by a chemical bond. The anchor bolt assembly comprises a shaft formed with a leading section and a bottom section, and a nut connected to the bottom section. The nut is chemically bonded to the bolt so that it may be employed to mix a cementitious component for permanently fixing the shank in a mine rock bore. Yet, after the shank is so fixed, the nut is then movable along the bottom of the shaft under the application of a predetermined torque to tension the bolt and strengthen the mine roof rock.

In a more specific aspect of this invention, a method and apparatus is provided for strengthening rock formations in subterranean cavities such as mines, subway tunnels and the like. A bore is formed in the rock structure at an area of suspected weakness, and a capsule or cartridge of cementitious material is inserted into the bore. The anchoring cement is preferably a resin and catalyst which form a quick setting cement when mixed together. An anchor bolt according to this invention is adapted to be secured within the bore by the cement. The anchor bolt comprises a shaft formed with a leading section and threaded bottom section. A nut which may or may not be connected to a faceplate washer is threaded onto the end of the bottom section of the shaft and releasably secured thereto by an adhesive bond.

To secure the anchor bolt in place, the leading section of the shaft is first inserted into the bore so that it pierces one or more capsules containing the resin and catalyst. The trailing end of the shaft, including the portion of the bottom section to which the nut is adhesively bonded, extends outwardly from the bore with the leading section in place. The nut and shaft are rotated as a unit to mix the resin and catalyst material forming the anchoring cement and distribute it within the bore and along the length of the leading section of the shaft. After a predetermined mixing period, rotation of the shaft is stopped and the anchoring cement is allowed to cure or set to secure the shaft within the rock bore. Additional torque is then applied to the nut to break the adhesive bond between it and the bottom section of the shaft without affecting the bond between the anchoring cement and the leading section of the shaft within the bore. The nut is optionally then advanced along the shank section until the washer engages the exterior of the rock structure and a sufficient tensioned pullup or tightening down of the anchor bolt shaft is accomplished.

In one form of this invention, the leading section and bottom section of the shaft are manufactured separately and connected together prior to installation. The leading section is formed with a threaded bore at one end adapted to receive a threaded end of a shank section. Preferably, an adhesive material is applied to increase the strength of the connection between the leading section and shank section. In a preferred embodiment, the shank section is smaller in diameter than the leading section and is made of hardened, cold drawn steel, while the leading section is a softer, low carbon steel. This permits the shank section to be bent relative to the leading section to permit installation where space requirements restrict the length of the anchor bolt which can be used. Once the leading section of the shaft is in position within a rock bore, the shank section may then be bent back to its original position to complete the installation.

In a further specific aspect of this invention, the leading section is formed with threads in the opposite direction as the threads of the bottom section. Preferably, the threads of the leading section include elongated ridges formed in either a flat or concave shape. This threaded configuration of the leading section aids in distributing and maintaining the anchoring cement within the rock bore and causes the anchoring cement to be captured or collected on the widened thread ridges to enhance the bond between the anchor bolt and cement.

In another aspect of this invention, the nut is formed with a recess extending inwardly from one face to a predetermined depth. The depth of the recess in the nut is approximately equal to the distance along the bottom or shank section of the shaft which the nut should be advanced to properly tighten the nut and faceplate washer against the rock structure once the anchor bolt is cemented in place. The nut in the recess thus acts as a fail-safe indicator for the installation crews of the amount of torque which should be applied to the nut to avoid damaging the bond between the leading section and anchoring cement.

Unlike prior art chemical anchor bolts, the temporary or releasable connection between the nut and shaft of this invention is a chemical bond created by an adhesive material. Mechanical-type connections between a cylindrical anchor and bolt, or between a shaft and nut, are subject to adverse environmental conditions and tolerance variations which can increase or decrease the torque required to break such connections and provide the miner with a false indication of torque being applied during the installation. The strength of the adhesive bond between the nut and shank or bottom section of the invention is much more predictable and repeatable than that of prior art mechanical connections and can be broken by the application of substantially the same torque time after time. This eliminates guesswork in the application of torque during the installation of the anchor bolts of this invention to protect the bond between the shaft and anchoring cement within the rock bore. In addition, with the provision of a recess in the nut, the guesswork is eliminated as to how tightly the nut and washer face plate should be tightened against the rock surface.

DESCRIPTION OF THE DRAWINGS

The structure, operation and advantages will become further apparent upon consideration of the following description taken in conjunction with the accompanying drawings wherein.

DETAILED DESCRIPTION OF THE INVENTION

Figure 1:
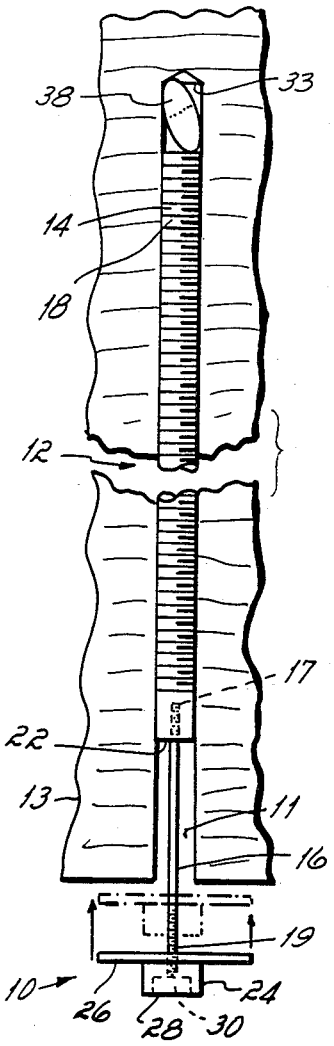
FIG. 1 is a front view in partial cross section of one form of the anchor bolt of this invention partially inserted within a bore of a rock structure, in a position to mix the resin-catalyst material.
Figure 2:
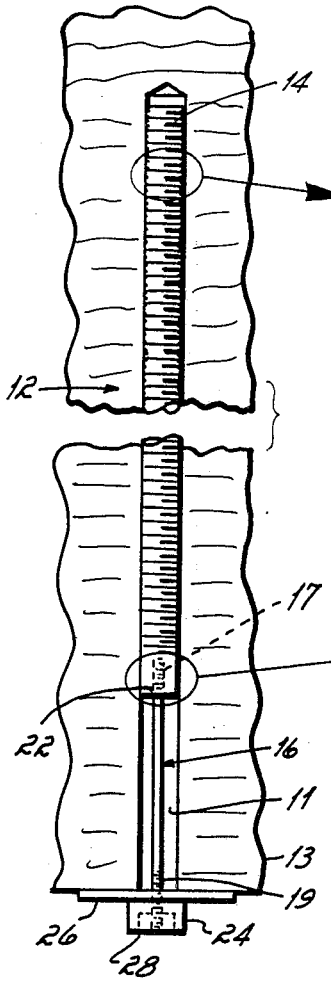
FIG. 2 is a view of the anchor bolt of FIG. 1 seated within the bore and fixed to the cementitious material.
Figure 3:
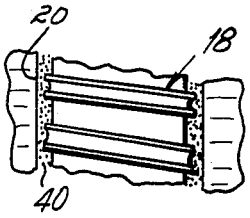
FIG. 3 is an enlarged view of a portion of the leading section of the shaft of this invention.
Figure 4:
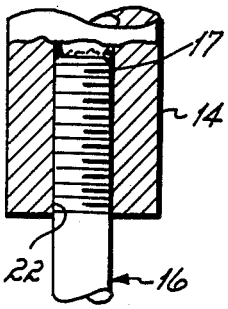
FIG. 4 is an enlarged view of the connection between the shank section and leading section of the shaft herein.

Referring now to the drawings, an anchor bolt 10 according to this invention is adapted to be cemented within a bore 11 formed in a rock structure 13. The anchor bolt 10 comprises a shaft 12 including an elongate leading section 14 connected to a bottom or shank section 16. The leading section 14 of the shaft 12 is preferably threaded along substantially all of its length, and, as shown in FIG. 3, the threads 18 include extended arcuate ridges 20 which are preferably flat or concave in shape. The ends 17, 19 of the bottom or shank section 16 are threaded in the opposite direction of the main section threads 18, and one end 17 thereof is engageable within a threaded bore 22 formed in an end of the leading section 14 as shown in FIG. 4. Preferably, an adhesive material is applied to the end 17 of shank section 16 to strengthen its connection with the bore 22 of leading section 14. While there are a variety of metal-to-metal adhesives suitable for connecting the leading and shank sections 14, 17, one presently preferred adhesive material is an anaerobic cement formed by modifying Loctite 680 adhesive, Loctite being the registered trademark of the Loctite Corporation. Loctite 680 is a known, readily available material which is thermoset plastic dimethacrylate of methacrylic ester and maleic acid. It is preferably modified for use in this invention by increasing the percentage of thixotrophic agent to yield a more viscous cement which has better adhesion properties and is less subject to run-off. A viscosity in the range of 20,000 to 30,000 centipoise has proven to provide acceptable viscosity.

As illustrated in the drawings, the shank section 16 is preferably formed with a smaller diameter than leading section 14. For example, in one presently preferred embodiment of the anchor bolt 10 herein, the diameter of the leading section 14 is $\frac{3}{4}$ inch and the shank section 16 is $\frac{1}{2}$ inch in diameter for use in a bore 11 of rock structure 13 having approximately a 1 inch diameter. In another form, these sections may be supplied in parts and assembled during installation and, further, in such an event, the diameter may be the same or significantly larger. The shank section 16 is preferably formed of hardened, cold rolled steel, whereas the leading section 14 of shaft 12 is formed of a softer steel having a lesser carbon content. A reduction in the diameter of the hardened shank section 16 not only reduces the weight of anchor bolt 10, but permits the shank section 16 to be bent at an angle relative to the leading section 14 to permit installation of the anchor bolt 10 in applications where space requirements restrict the length of the anchor bolt which can be used. The shank section 16 can then be returned to its original position without weakening it or the bond connecting the shank section 16 with the leading section 14.

The opposite end 19 of the shank section 16, which is also threaded, is adapted to receive a nut 24 which may have a bearing plate or faceplate washer 26 connected thereto. The nut 24 is threaded onto the end 19 of shank section 16 so that the washer 26 is between the nut and leading section 14 and is adhesively bonded thereto with an adhesive material preferably the same as that connecting the shank and leading sections 16, 14. The nut 24 is formed with a recess 28 which extends inwardly from the outer surface of nut 24 to a predetermined depth. Prior to installation of the anchor bolt 10, the nut 24 is adhesively bonded to the shaft 12 in a position so that the end of shank section 16 is substantially flush with the base 30 of recess 28.

The advantages of the anchor bolt 10 herein are best appreciated by considering an installation procedure. Initially, the bore 11 is formed in rock structure 13 so that the distance from the exterior surface 36 of the rock structure 13 to the terminal end 33 of the bore 11 is at least equal to the length of shaft 12. A cartridge or capsule 38 is inserted within bore 11 near its terminal end 33. The capsule 38 contains a resin material and a hardener or catalyst, which, when mixed together, form an anchoring cement. The resin and catalyst components of the anchoring cement 40 may be contained in separate capsules 38 or in separate compartments of a single capsule 38. For purposes of the present discussion, it is assumed that both the resin and catalyst components of the anchoring cement 40 are contained in a single capsule 38 which are readily available from a number of manufacturers.

The leading section 14 of shaft 12 is inserted within the bore 11 and into contact with the capsule 38. The leading section 14 pierces the capsule 38 so that the elements of the anchoring cement 40 begin to intermix. The shaft 12, including the shank section 16 and nut 24, is then rotated to agitate and mix the anchoring cement 40 so that its resin and catalyst components are completely combined. The threads 18 of the leading section 14 help distribute the anchoring cement 40 upwardly within the bore 11 to avoid leakage, and along the length of the leading section 14 so that an effective bond may be created between the anchoring cement 40 and leading section 14. As shown in FIG. 3, the ridges 20 of threads 18 are preferably formed in an elongate, arcuate shape to provide a large surface area for of collection of the anchoring cement 40. This configuration of threads 18 not only aids in the distribution of the adhesive material 40 along the leading section 14, but also helps to prevent it from running or dripping out of the bore 32 during the mixing operation.

The shaft 12, and the nut 24 attached to the shank section 16, are rotated as a unit while the anchoring cement 40 is mixed within bore 11. The torque applied to the nut 24 to rotate shaft 12 during the mixing operation is relatively low and insufficient to break the adhesive bond between nut 24 and shank section 16. Therefore, a temporary adhesive bond is created between the nut 24 and shank 16 which does not involve a mechanical-type connection as in prior art anchor bolts.

After a predetermined period of time, the rotation of shaft 12 is stopped and the leading section 14 is positioned within the bore 32 so that the nut 24 and faceplate washer 26 extend outwardly a short distance from the exterior surface 36 of rock structure 13. The anchoring cement 40 is allowed to cure or set and it securely fixes the leading section 14 of shaft 12 within the rock structure bore 11. As mentioned above, current federal standards require the installed tension on anchor bolts to be on the order of 50% of the yield strength of the bolt. This is accomplished by a tension pullup or tightening down operation in which the faceplate washer 26 is brought into contact with and tightened against the exterior surface 36 of rock structure 13. With the leading section 14 of shaft 12 securely fixed within the bore 11 of rock structure 13, additional torque is applied to the nut 24 to break its adhesive bond with the shank section 16. An important aspect of this invention is that the adhesive material used to secure nut 24 to shank section 16 develops a chemical bond between the nut 24 and shank section 16 having a strength which is consistent and repeatable, so that the force or torque required to break the adhesive connection between nut 24 and shank section 16 varies little from one anchor bolt 10 to another even in adverse environmental conditions. This eliminates the guesswork in the installation operation as to the amount of torque which can be applied to nut 24 without damaging the cement securing the leading section 14 in place. In addition, it provides a fail-safe indication to the miner as to whether or not the anchoring cement 40 is being mixed, or the nut 24 is being advanced, at the appropriate times during an installation operation. Once the adhesive bond between nut 24 and shank section 16 is broken, the nut 24 and attached faceplate washer 26 are threaded along the shank section 16 to the exterior surface 36 of rock structure 34 where the nut is secured to complete the pullup or tightening down operation.

Figure 5:
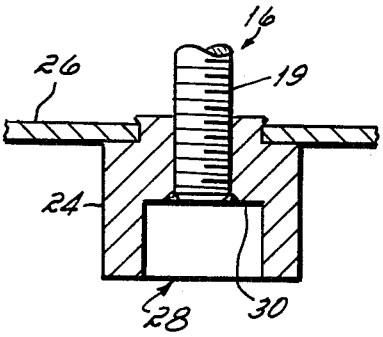
FIG. 5 is an enlarged view of the nut having a faceplate washer, and shank or bottom section of the shaft, prior to tightening of the faceplate washer against the rock structure.
Figure 6:
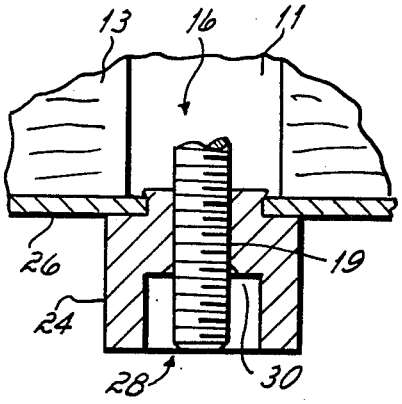
FIG. 6 is a view of the nut as shown in FIG. 5, with the nut and face plate washer tightened against the rock structure.

Referring to FIG. 5 and 6, another aspect involving the fail-safe installation of this invention is illustrated. Before the nut 24 is advanced upwardly along the shank section 16, as in FIG. 5, the end of the shank section 16 is approximately flush with the base 30 of recess 28 formed in nut 24. As the nut 24 is advanced along the shank 16, the shank section 16 moves within the recess 28 toward the outer face of nut 24. The proper amount of tension pullup or tightening down of the shaft 12 is provided when the end of shank section 16 advances to a point substantially flush with the outer surface of nut 24 as shown in FIG. 6. This provides the installation crew with a reliable fail-safe indication of the proper tension which can be applied to shaft 12 without disturbing the cement bond between leading section 14 and the anchoring cement 40. Also regular nut and shaft arrangements may be made where the nut is initially flush with the end of the shaft and the shaft is subsequent upon tightening of the nut exposed about one-half inch as a fail-safe measure.

Figure 7:
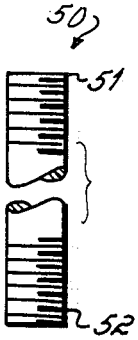
FIG. 7, is another anchor bolt structure of this invention where the shaft is one-piece having a leading section and a bottom section.

FIG. 7 is another anchor bolt structure of this invention wherein the shaft 50 is one-piece rather than having a leading and shank section as described. In this one-piece structure having threaded ends 51 and 52, all of the advantages of this invention are secured except those associated with the benefit of having a reduced shank section. In this one-piece structure, the bolt can be made of higher carbon steel. The operation of the one-piece or multi-piece bolt structure is essentially the same.

While the invention has been described with reference to a preferred embodiment, it will be understood by those skilled in the art that various changes may be made and equivalents my be substituted for elements thereof without departing from the scope of the invention. In addition, many modifications may be made to adapt a particular situation or material to the teachings of the invention without departing from the essential scope thereof. Therefore, it is intended that invention not be limited to the particular embodiment disclosed as the best mode contemplated for carrying out this invention, but that the invention will include all embodiments falling within the scope of the appended claims.

I claim:

1. An anchor bolt assembly adapted to be secured by an anchoring cement within a bore formed in a rock structure to strengthen the rock structure comprising:

a shaft having a leading section and a bottom section, said leading section being insertable within said bore and at least a portion of said bottom section extending outwardly from said bore;

a nut disposed on said bottom section of said shaft outwardly from said bore, said nut being bonded by an adhesive to said bottom section;

said shaft leading section being adapted to be advanced into contact with said anchoring cement and rotated by said nut to mix and distribute said anchoring cement within said bore and along said shaft leading section prior to said cement setting, said nut after said cement sets to fix said shaft in said bore being adapted to rotate relative to said fixed shaft to break said adhesive bond with said bottom section, said nut thereafter being adapted to advance along said bottom section for placing said shaft under tension to support said rock structure.

2. The anchor bolt assembly as in claim 1 in which said leading section of said shaft is threaded, said threads including an elongate ridge portion to distribute and at least partially collect said anchoring cement.

3. The anchor bolt assembly of claim 2 in which said bottom section comprises a shank formed with threads on at least one end, said threads of said leading section and said shank section being in the opposite direction.

4. The anchor bolt assembly as in claim 1 in which said adhesive is a thermoset plastic dimethacrylate of methacrylic ester and maleic acid.

5. The anchor bolt assembly as in claim 1 in which said bottom section comprises a shank having a smaller diameter than said leading section.

6. The anchor bolt assembly as in claim 5 in which said leading section of said shaft is formed with a threaded bore at one end, and said shank is threaded at each end, one end of said shank section being threaded within said threaded bore of said leading section and bonded thereto by an adhesive.

7. The anchor bolt assembly as in claim 6 in which said shank of said shaft is formed of hardened, cold drawn steel, said shank section being adapted to bend relative to said leading section of said bolt and then return to its original position without weakening.

8. The anchor bolt assembly as in claim 1 in which said nut is formed with recess extending inwardly from one face to a predetermined depth, the depth of said recess in said nut providing an indication of the preferred distance for advancing said nut along said bottom section of said shaft for tensioning said shaft.

9. The anchor bolt assembly as in claim 1 in which said nut has a bearing plate.

10. An anchor bolt assembly adapted to be secured by a settable anchoring cement and within a bore formed in a rock structure to strengthen the rock structure comprising:

a shaft having a leading section formed with threads having elongate ridge portions, and a threaded shank section, said leading section being insertable within said bore and at least a portion of said shank section extending outwardly from said bore;

a nut being adhesively bonded to said shank section of said shaft outwardly of said bore;

said shaft leading section being adapted to be advanced into contact with said anchoring cement and rotated by said nut so that said threads having said elongate ridge portions mix and distribute said anchoring cement within said bore and along said shaft leading section prior to said cement setting, said nut after said cement sets to fix said shaft in said bore being adapted to rotate relative to said fixed shaft to break said adhesive bond with said shank section, said nut thereafter being adapted to advance along said shank section for placing said shaft under tension to support said rock structure.

11. The anchor bolt assembly of claim 10 in which said elongate ridge portions of said threads of said leading section are flat.

12. The anchor bolt assembly of claim 10 in which said elongate ridge portions of said threads of said leading section are concave.

13. A method of installing an anchor bolt into a rock structure comprising the steps of:

forming a bore in said rock structure;

inserting an anchoring cement into said bore;

advancing an anchor bolt within said bore and into contact with said anchoring cement, said anchor bolt including a leading section and a bottom section, a nut being disposed on said bottom end of said shaft and bonded thereto by an adhesive;

rotating said nut and shaft to mix and distribute said anchoring cement within said bore and along said leading section of said shaft;

allowing said anchoring cement to set to secure said shaft within said bore;

rotating said nut to break said adhesive bond with said bottom section; and advancing said nut along said bottom section until sufficient tension is placed upon said bolt to securely tighten it within said rock structure.

* * * * *